US006400068B1

(12) United States Patent
Jaskie et al.

(10) Patent No.: US 6,400,068 B1
(45) Date of Patent: Jun. 4, 2002

(54) FIELD EMISSION DEVICE HAVING AN EMITTER-ENHANCING ELECTRODE

(75) Inventors: James E. Jaskie; Albert Alec Talin, both of Scottsdale; Bernard F. Coll, Fountain Hills, all of AZ (US); Kathleen Anne Tobin, San Antonio, TX (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/484,665

(22) Filed: Jan. 18, 2000

(51) Int. Cl.[7] ..... H01J 1/304
(52) U.S. Cl. ..... 313/309; 313/306
(58) Field of Search ..... 313/309, 141, 313/306–308; 445/24

(56) References Cited

U.S. PATENT DOCUMENTS 5,378,182 A * 1/1995 Liu ..... 445/24
5,850,120 A * 12/1998 Okamoto ..... 313/309
5,865,657 A * 2/1999 Haven et al. ..... 445/24
5,969,467 A * 10/1999 Matsuno ..... 313/309
6,005,335 A * 12/1999 Potter ..... 313/309

* cited by examiner

*Primary Examiner*—Kenneth J. Ramsey
(74) *Attorney, Agent, or Firm*—Kevin D. Wills; William E. Koch

(57) ABSTRACT

A field emission device (100) includes an electron emitter (115) and an emitter-enhancing electrode (117) having an enhanced-emission structure (131), which is disposed proximate to electron emitter (115). Enhanced-emission structure (131) is embodied by, for example, each of the following structures: a tapered portion (118) of emitter-enhancing electrode (117), an electron-emissive edge (135) that is generally parallel to an axis (136) of electron emitter (115), a combination of a conductive layer (137) and an electron-emissive layer (138) that is disposed proximate to an edge (133) of conductive layer (137), and an electron-emissive layer (146) having a thickness of less than about 500 angstroms.

20 Claims, 7 Drawing Sheets

FIELD EMISSION DEVICE HAVING AN EMITTER-ENHANCING ELECTRODE

REFERENCE TO RELATED APPLICATION

Related subject matter is disclosed in a U.S. patent application entitled "Method for Enhancing Electron Emission in a Field Emission Device, " filed on even date herewith, and assigned to the same assignee.

1. Field of the Invention

The present invention relates, in general, to field emission devices and, more particularly, to the structure of electrodes of the cathode plate of a field emission device.

2. Background of the Invention

It is known in the art that the electron emitters of a field emission device can become contaminated during the operation of the field emission device. The contaminated emissive surfaces typically have electron emission properties that are inferior to those of the initial, uncontaminated emissive surfaces. Several schemes have been proposed for conditioning the electron emitters and removing contaminants from the emissive surfaces thereof.

For example, it is known in the art to decontaminate or condition the emissive surfaces by scrubbing them with an electron beam provided by the electron emitter structures. An example of this scheme is described in U.S. Pat. No. 5,587,720, entitled "Field Emitter Array and Cleaning Method of the Same" by Fukuta et al. However, this type of scheme can result in inefficient cleaning due to the electronic bombardment of surfaces other than the electron emissive surfaces, which can result in undesirable desorption of contaminants.

It is also known in the art to decontaminate or condition the emissive surfaces by applying a high, positive voltage pulse to the gate extraction electrode. This scheme is described in U.S. Pat. No. 5,639,356, entitled "Field Emission Device High Voltage Pulse System and Method" by Levine. Levine teaches that the high, positive voltage pulse increases the electric field at the emissive surfaces, thereby decreasing the adhesion energy of absorbates and facilitating the desorption of contaminants. However, this method does not provide the conditioning benefits realized from an electron scrubbing technique, wherein the emissive surfaces are bombarded with electrons.

Accordingly, there exists a need for an improved field emission device, which overcomes at least these shortcomings of the prior art.

BRIEF DESCRIPTION OF THE DRAWINGS

Referring to the drawings.

Figure 1:
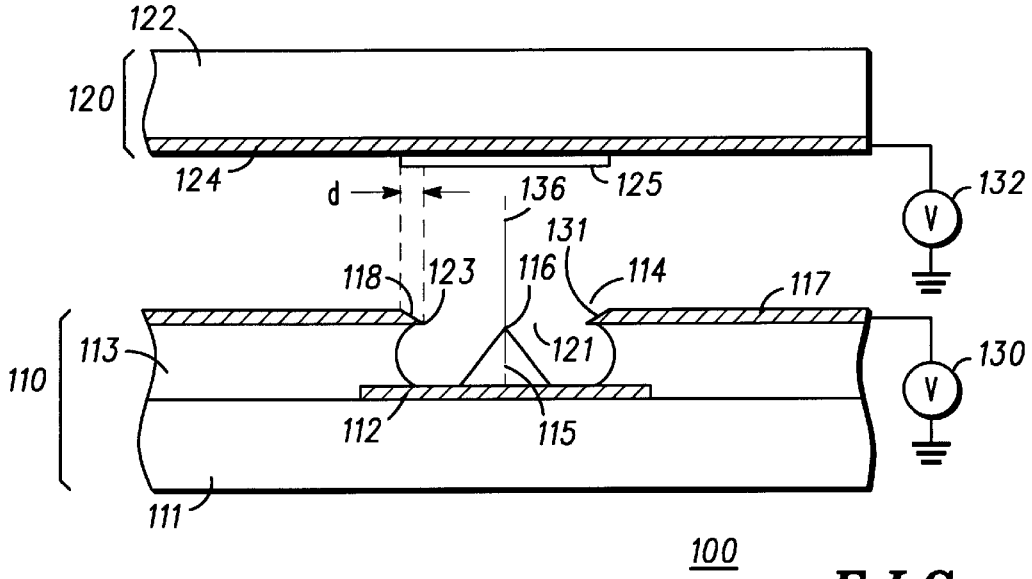
FIG. 1 is a cross-sectional view of a field emission device, in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a field emission device having an emitter-enhancing electrode. The emitter-enhancing electrode is useful for cleaning, conditioning, and sharpening the electron emitter. The emitter-enhancing electrode of the invention has an enhanced-emission structure, which facilitates electron emission from the emitter-enhancing electrode. The emitter-enhancing electrode is positioned so that, when it is caused to emit electrons, the electrons are received at the electron-emissive portion of the electron emitter. Although the drawings illustrate display devices, the scope of the invention is not limited to displays. Rather, the invention can be embodied by other types of field emission devices, such as switches, amplifiers, and the like. Furthermore, the scope of the invention is not limited to conically-shaped or symmetrical emitters. For example, the invention can be embodied by devices having surface emitters, edge emitters, or emitters that do not require emitter wells.

FIG. 1 is a cross-sectional view of a field emission device (FED) 100, in accordance with a preferred embodiment of the invention. FED 100 includes a cathode plate 110 and an anode plate 120. Cathode plate 110 includes a substrate 111, which can be made from glass, silicon, and the like. A cathode 112 is disposed upon substrate 111. Cathode 112 is connected to a first voltage source (not shown). A dielectric layer 113 is disposed upon cathode 112, and further defines an emitter well 114.

An electron emitter 115, such as a Spindt tip, is disposed in emitter well 114. Electron emitter 115 has an electron-emissive tip 116, from which electrons can be emitted by applying a suitable electric field thereto. Methods for fabricating cathode plates for matrix-addressable FED's are known to one of ordinary skill in the art. Anode plate 120 is disposed to receive electrons emitted by electron emitter 115.

In accordance with the invention, an emitter-enhancing electrode 117 is formed on dielectric layer 113. Emitter-enhancing electrode 117 is connected to a second voltage source 130. Emitter-enhancing electrode 117 of FIG. 1 serves two functions. First, it is useful for applying an electric field for extracting electrons from electron emitter 115. Second, it is useful for supplying electrons for cleaning and conditioning electron emitter 115.

Anode plate 120 includes a transparent substrate 122 made from, for example, glass. An anode 124 is disposed on transparent substrate 122. Anode 124 is preferably made from a transparent conductive material, such as indium tin oxide. Anode 124 is connected to a third voltage source 132. Third voltage source 132 is useful for applying an anode voltage to anode 124.

A phosphor 125 is disposed upon anode 124. Phosphor 125 is cathodoluminescent. Thus, phosphor 125 emits light upon activation by electrons. Methods for fabricating anode plates for matrix-addressable FED's are known to one of ordinary skill in the art.

FED 100 can be operated in a display mode and in a conditioning mode. When FED 100 is operated in the display mode, an image is produced at anode plate 120. The image is produced by causing electron emitter 115 to emit electrons, which are attracted toward phosphor 125. To cause electron emission from electron emitter 115, the positive potential at emitter-enhancing electrode 117 is greater than the potential at cathode 112. For example, the potential at emitter-enhancing electrode 117 can be about 100 volts, while cathode 112 is maintained at ground potential. In this manner, emitter-enhancing electrode 117 functions as an extraction electrode during the display mode of operation.

Also during the display mode of operation, the potential at anode 124 is selected to be greater than that at emitter-enhancing electrode 117. For example, a potential within the range of 1000–5000 volts can be applied to anode 124.

During the conditioning mode of operation, emitter-enhancing electrode 117 does not function as an extraction electrode for extracting electrons from electron emitter 115. Rather, emitter-enhancing electrode 117 is caused to emit electrons toward electron-emissive tip 116 of electron emitter 115. This is achieved by applying to emitter-enhancing electrode 117 a potential, which is sufficiently less than the potential at electron emitter 115 to cause emitter-enhancing electrode 117 to emit electrons. For example, emitter-enhancing electrode 117 can be maintained at ground potential, while a positive potential of about 100 volts is applied to electron emitter 115.

During the conditioning mode of operation of FED 100, the potential at anode 124 is reduced to a value sufficient to prevent attraction toward anode 124 of the electrons that are emitted by emitter-enhancing electrode 117. For example, anode 124 can be maintained at ground potential during the conditioning mode of operation.

In accordance with the invention, emitter-enhancing electrode 117 has an enhanced-emission structure 131, which is disposed proximate to electron emitter 115. The position of enhanced-emission structure 131 is selected so that electrons emitted by enhanced-emission structure 131 are received by electron-emissive tip 116 of electron emitter 115.

Enhanced-emission structure 131 facilitates electron emission during the conditioning mode of operation. Enhanced-emission structure 131 is a structure that is not found in prior art gate extraction electrodes. Enhanced-emission structure 131 is useful for realizing enhanced electron emission, as compared to electron emission that could be realized from a prior art gate extraction electrode.

The structure of a prior art gate extraction electrode can be defined by the process for its fabrication. A prior art gate extraction electrode is typically fabricated by first depositing a dielectric layer. Then, a conductive layer, which typically has a thickness of about 1000 angstroms, is deposited on the dielectric layer. The conductive layer is then patterned. Thereafter, the dielectric layer is selectively etched to form the emitter well. The portion of a prior art gate extraction electrode, which is near the opening of the emitter well, typically has negligible or no tapering.

As depicted in FIG. 1, and in accordance with a preferred embodiment of the invention, emitter-enhancing electrode 117 has a tapered portion 118. Tapered portion 118 defines an electron-emissive edge 123. Tapered portion 118 and electron-emissive edge 123 provide enhanced-emission structure 131. Electron-emissive edge 123 further defines an opening 121.

Tapered portion 118 extends a distance, d, in a direction away from electron-emissive edge 123 and into emitter-enhancing electrode 117. Distance d is preferably within a range of 2 to 3 times the thickness of emitter-enhancing electrode 117.

Figure 2:
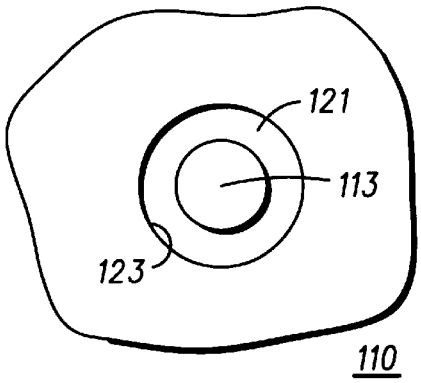
FIG. 2 is a top plan view of a cathode plate of the field emission device of FIG. 1.

FIG. 2 is a top plan view of cathode plate 110 of FED 100 of FIG. 1. In the preferred embodiment of FIGS. 1 and 2, electron-emissive edge 123 defines a circular opening.

Figure 3:
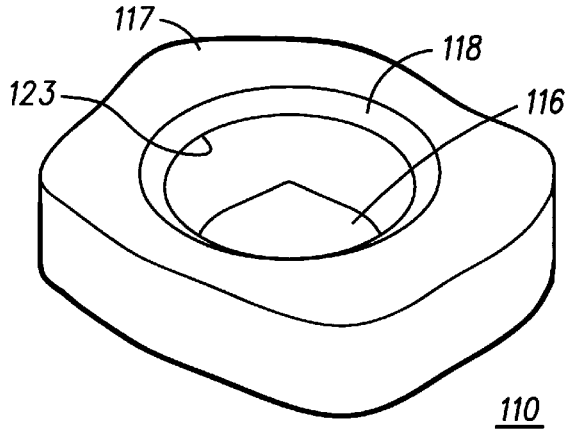
FIG. 3 is a perspective view of the cathode plate of the field emission device of FIG. 1.

FIG. 3 is a perspective view of cathode plate 110 of FED 100 of FIG. 1. FIG. 3 further illustrates the tapering of tapered portion 118 of emitter-enhancing electrode 117.

Figure 4:
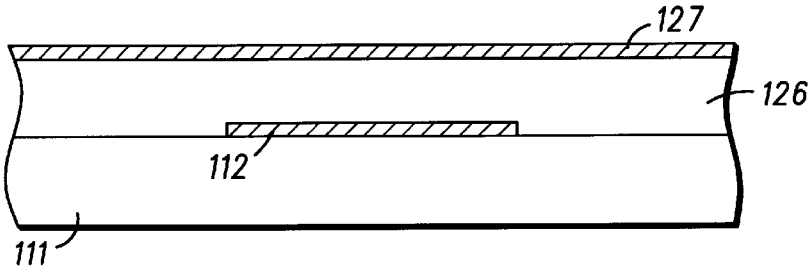
FIGS. 4–6 are cross-sectional views of structures realized during the fabrication of the field emission device of FIG. 1.
Figure 5:
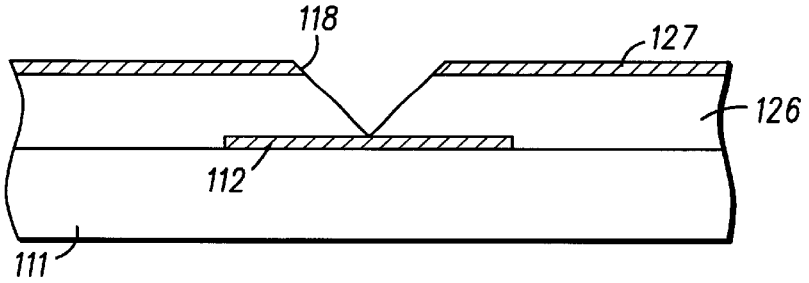
Figure 6:
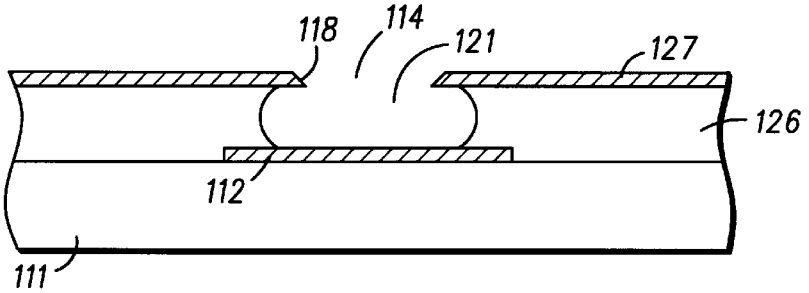

FIGS. 4–6 are cross-sectional views of structures realized during the fabrication of FED 100 of FIG. 1. As illustrated in FIG. 4. First, cathode 112 is formed on substrate 111. Thereafter, a layer 126 of a dielectric material, such as silicon dioxide or silicon nitride, is deposited on cathode 112. A layer 127 is deposited on layer 126. Preferably, layer 127 is made from a conductive, electron-emissive material. Most preferably, layer 127 is made from molybdenum. Niobium or carbon can also be chosen.

As illustrated in FIG. 5, layer 127 is etched using a mass-flow-limiting process. This process is employed to form tapered portion 118 of emitter-enhancing electrode 117, in accordance with the invention.

Thereafter, layer 126 is etched to form emitter well 114, thereby realizing the structure of FIG. 6. Layer 126 can be etched using a convenient dry or wet etch process, such as by employing hydrogen fluoride. After emitter well 114 is formed, electron emitter 115 is deposited by methods known to one skilled in the art. Because opening 121 is circular in the embodiment of FIG. 6, a conical emitter is formed.

Furthermore, the shape of the cross-section of electron emitter 115 is the same as the shape of opening 121.

Figure 7:
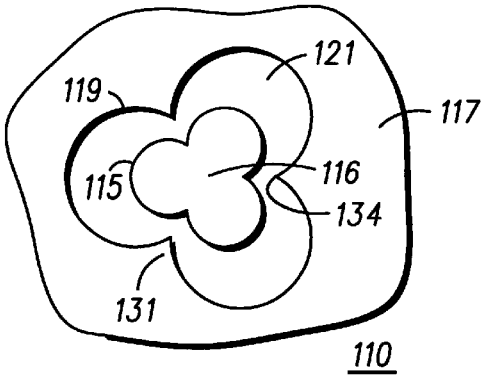
FIG. 7 is a top plan view of a cathode plate of a field emission device having an emitter-enhancing electrode, which has a distal edge and an enhanced-emission structure that is closer to the electron-emissive tip than the distal edge, in accordance with another embodiment of the invention.

FIG. 7 is a top plan view of cathode plate 110 of FED 100 having emitter-enhancing electrode 117, which has a distal edge 119 and enhanced-emission structure 131 that is closer to electron-emissive tip 116 than distal edge 119, in accordance with another embodiment of the invention. In the embodiment of FIG. 7, the shape of opening 121 defines three points 134, which are positioned so that, when emitter-enhancing electrode 117 is caused to emit electrons, electrons are received by electron-emissive tip 116. The scope of the invention is not limited to a device having three of points 134. That is, the invention is also embodied by a device having one, two, or more than three of points 134.

Distal edge 119 is coextensive with enhanced-emission structure 131. In order to enhance the local electric field at enhanced-emission structure 131 during the conditioning mode of operation, the distance between distal edge 119 and electron-emissive tip 116 is made greater than the distance between enhanced-emission structure 131 and electron-emissive tip 116.

In the embodiment of FIG. 7, distal edge 119 is a smooth curve and does not define an angle. The smoothness of distal edge 119 is useful for producing an electron emitter that does not have protruding edges. A protruding edge defined by the surface of the electron emitter is undesirable because it may cause poor efficiency in the operation of FED 100. That is, during the display mode of operation, such a protruding edge may emit electrons, which are likely to be attracted to the gate extraction electrode, rather than to the anode. This loss in current results is poor device efficiency.

To produce electron emitter 115 having a cross-section, which has the same shape as opening 121, electron emitter 115 is formed by depositing the electron-emissive material when the opening to emitter well 114 is defined by opening 121 of emitter-enhancing electrode 117.

Figure 8:
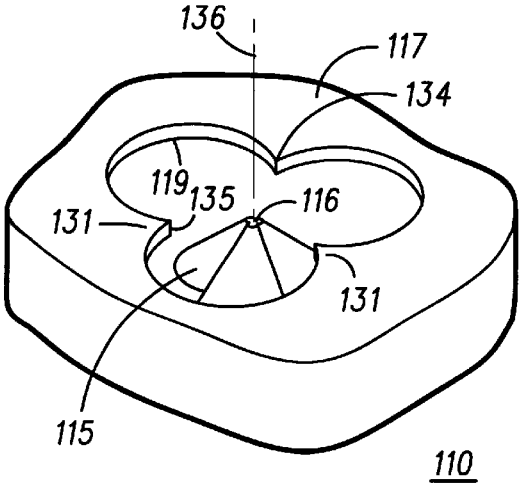
FIG. 8 is a perspective view of the cathode plate of FIG. 7.

FIG. 8 is a perspective view of cathode plate 110 of FIG. 7. In the embodiment of FIG. 8, enhanced-emission structure 131 further defines an electron-emissive edge 135, which is generally parallel to an axis 136 of electron emitter 115.

Figure 9:
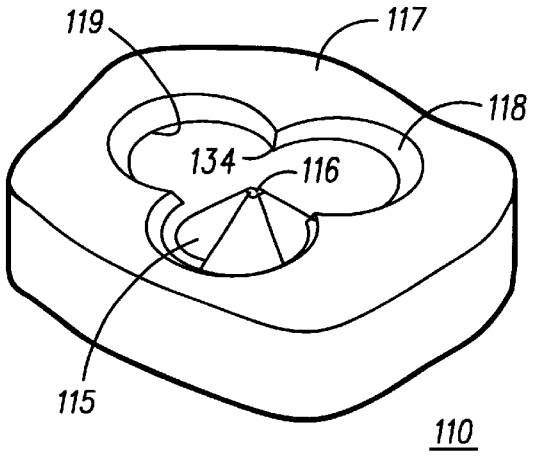
FIG. 9 is a view similar to that of FIG. 8 of a cathode plate having an emitter-enhancing electrode, which is tapered at the distal edge and at the enhanced-emission structure, in accordance with still another embodiment of the invention.

FIG. 9 is a view similar to that of FIG. 8 of cathode plate 110 having emitter-enhancing electrode 117, which is tapered at distal edge 119 and at enhanced-emission structure 131, in accordance with still another embodiment of the invention. The tapering is useful for enhancing electron-emission from distal edge 119 and from point 134.

Figure 10:
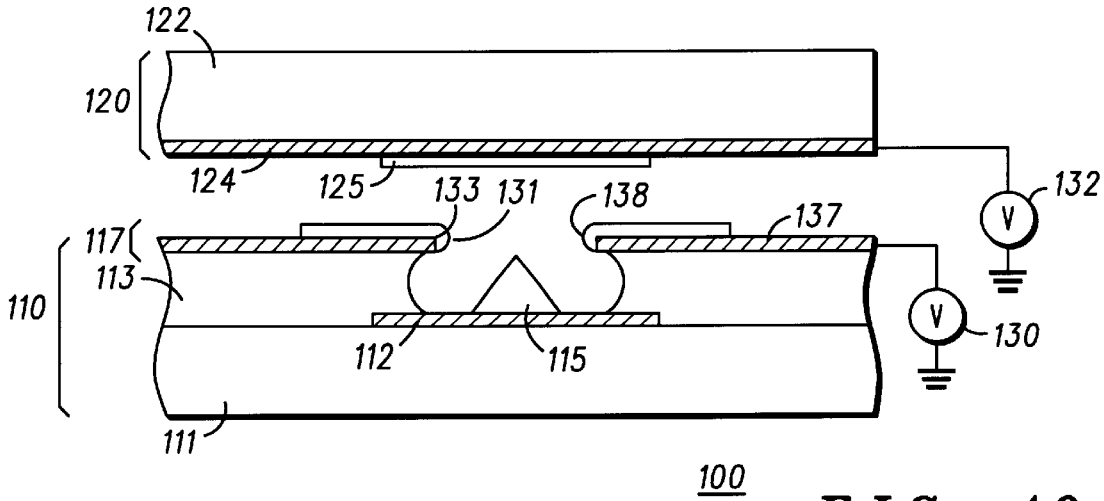
FIG. 10 is a cross-sectional view of a field emission device having an emitter-enhancing electrode, which includes an emissive layer and a conductive layer, in accordance with yet another embodiment of the invention.

FIG. 10 is a cross-sectional view of FED 100 having emitter-enhancing electrode 117, which includes an electron-emissive layer 138 and a conductive layer 137, in accordance with yet another embodiment of the invention. Conductive layer 137 is disposed on dielectric layer 113 and is made from a conductive material. Electron-emissive layer 138 is disposed on conductive layer 137 and is made from an electron-emissive material. The electron-emissive material of electron-emissive layer 138 can be selected from an electron-emissive form of carbon, such as diamond, or an electron-emissive metal, such as molybdenum. Electron-emissive layer 138 has electron-emission characteristics that are better than those of conductive layer 137. For example, electron-emissive layer 138 can have a lower work function than conductive layer 137. Also, conductive layer 137 has current-carrying and/or mechanical characteristics that are better than those of electron-emissive layer 138.

Conductive layer 137 defines an edge 133, which is disposed proximate to electron emitter 115. In general, electron-emissive layer 138 is disposed proximate to edge 133. Preferably, electron-emissive layer 138 at least partially coats edge 133 of conductive layer 137. In the embodiment of FIG. 10, enhanced-emission structure 131 is defined by the combination proximate to electron emitter 115 of conductive layer 137 and electron-emissive layer 138. Electron-emissive layer 138 is formed using a convenient deposition and patterning technique. Coating of edge 133 can be achieved by employing an angled-deposition technique.

Figure 11:
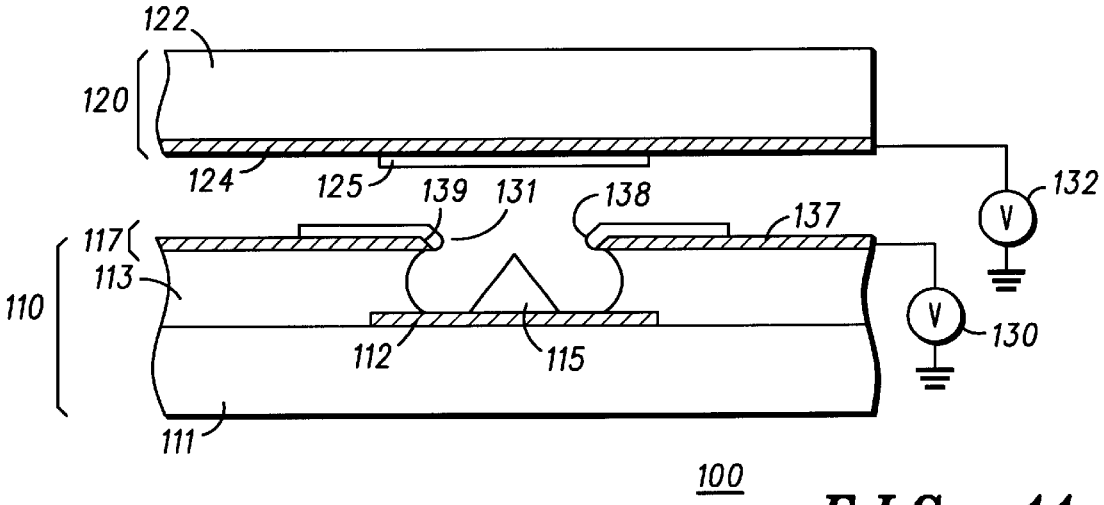
FIG. 11 is a cross-sectional view of a field emission device having an emitter-enhancing electrode, which includes an electron-emissive layer and a tapered conductive layer, in accordance with a further embodiment of the invention.

FIG. 11 is a cross-sectional view of FED 100 having emitter-enhancing electrode 117, which includes electron-emissive layer 138 and conductive layer 137, which further includes a tapered portion 139, in accordance with a further embodiment of the invention. Tapered portion 139 of conductive layer 137 is formed in a manner similar to that described with reference to FIG. 5. The sharp geometric feature of tapered portion 139 enhances the local electric field at enhanced-emission structure 131 during the conditioning mode of operation of FED 100.

Figure 12:
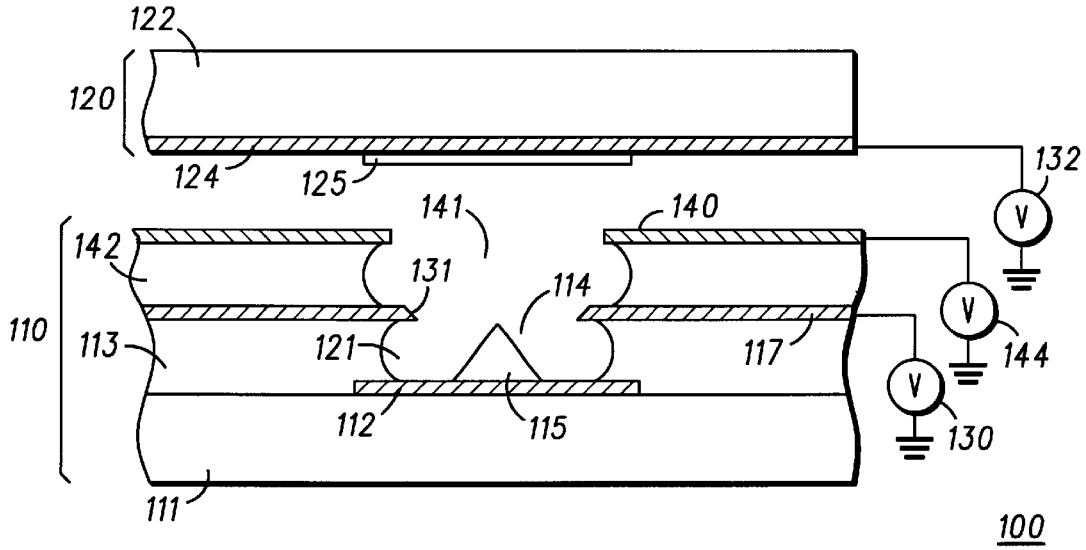
FIG. 12 is a cross-sectional view of a field emission device having a gate extraction electrode that is distinct from the emitter-enhancing electrode, in accordance with still a further embodiment of the invention.

FIG. 12 is a cross-sectional view of FED 100 having a gate extraction electrode 140 that is distinct from emitter-enhancing electrode 117, in accordance with still a further embodiment of the invention. Gate extraction electrode 140 is separated from emitter-enhancing electrode 117 by a second dielectric layer 142.

Gate extraction electrode 140 is made from a conductive material, which need not be electron-emissive. Subsequent to the formation of emitter-enhancing electrode 117 and electron emitter 115, a layer of a second dielectric material, which is distinct from that used for dielectric layer 113, is deposited on emitter-enhancing electrode 117. Gate extraction electrode 140 is made by depositing the conductive material on the layer of the second dielectric material and patterning the conductive material by using a standard gate-forming technique. Gate extraction electrode 140 defines an opening 141, which is in registration with opening 121 of emitter-enhancing electrode 117. Enhanced-emission structure 131 of the embodiment of FIG. 12 can include any of the enhanced-emission structures described with reference to the FIGS.

Gate extraction electrode 140 is connected to a fourth voltage source 144. During the display mode of operation of FED 100, the potentials at gate extraction electrode 140, emitter-enhancing electrode 117, anode 124, and electron emitter 115 are selected to cause electron emission from electron emitter 115 and to cause the electrons to be attracted toward anode 124. The potentials can be selected to also cause emitter-enhancing electrode 117 to emit electrons, which are also attracted toward anode 124. Furthermore, the potential at emitter-enhancing electrode 117 is less than that at gate extraction electrode 140. The potential at emitter-enhancing electrode 117 is also selected to ameliorate attraction thereto of electrons emitted by electron emitter 115.

During the conditioning mode of operation of the embodiment of FIG. 12, the potentials at gate extraction electrode 140, emitter-enhancing electrode 117, anode 124, and electron emitter 115 are selected to cause emitter-enhancing electrode 117 to emit electrons, which are thereafter attracted toward electron-emissive tip 116 and not toward gate extraction electrode 140 or toward anode 124.

Figure 13:
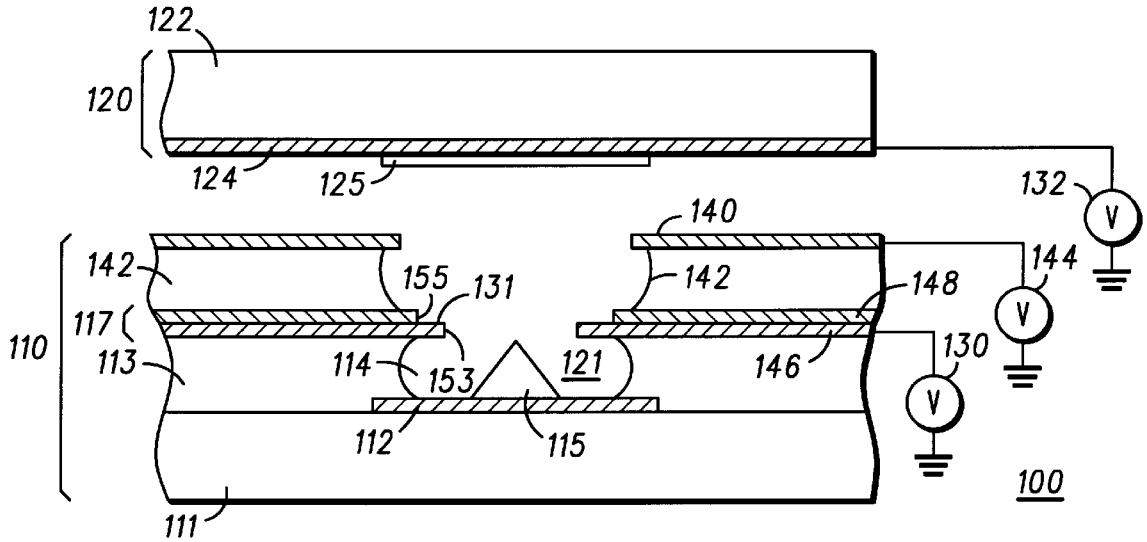
FIG. 13 is a cross-sectional view of a field emission device having an emitter-enhancing electrode, which includes a thin, electron-emissive layer and a second layer having an edge that is pulled back from an edge of the electron-emissive layer, in accordance with yet a further embodiment of the invention.

FIG. 13 is a cross-sectional view of FED 100 having emitter-enhancing electrode 117, which includes a thin, electron-emissive layer 146 and a second layer 148 having an edge 155 that is pulled back from an edge 153 of electron-emissive layer 146, in accordance with yet a further embodiment of the invention. Electron-emissive layer 146 preferably has a thickness of less than about 500 angstroms. In the embodiment of FIG. 13, the very thin edge 153 of electron-emissive layer 146 defines enhanced-emission structure 131. Edge 153 provides a sharp geometric feature for enhancing the local electric field during the conditioning mode of operation of FED 100.

Electron-emissive layer 146 is made from an electron-emissive material, such as molybdenum, diamond, and the like. Second layer 148 can be made from either a conductive or non-conductive material. If second layer 148 is non-conductive, second voltage source 130 is connected to electron-emissive layer 146.

If second layer 148 is conductive, it can be useful for improving the electrical current through emitter-enhancing electrode 117 during the conditioning mode of operation of FED 100. Additionally, second layer 148, whether conductive or non-conductive, can provide favorable mechanical properties to emitter-enhancing electrode 117. That is, second layer 148 can be useful for maintaining the structural integrity of enhanced-emission structure 131 during the formation of electron emitter 115 and second dielectric layer 142.

Figure 14:
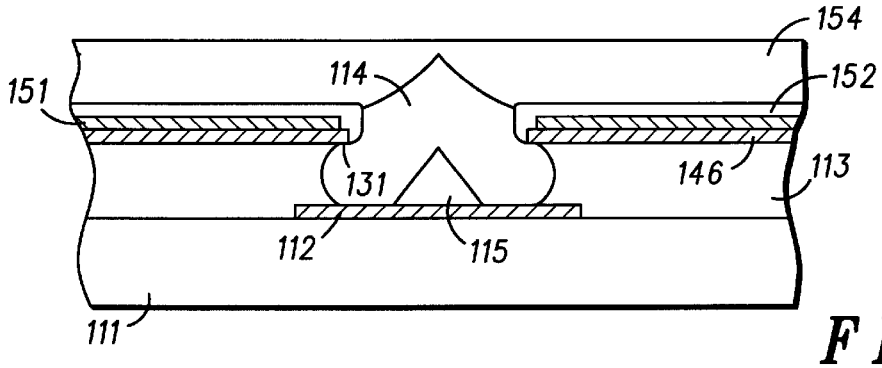
FIGS. 14–15 are cross-sectional views of structures realized during the fabrication of the field emission device of FIG. 13.
Figure 15:
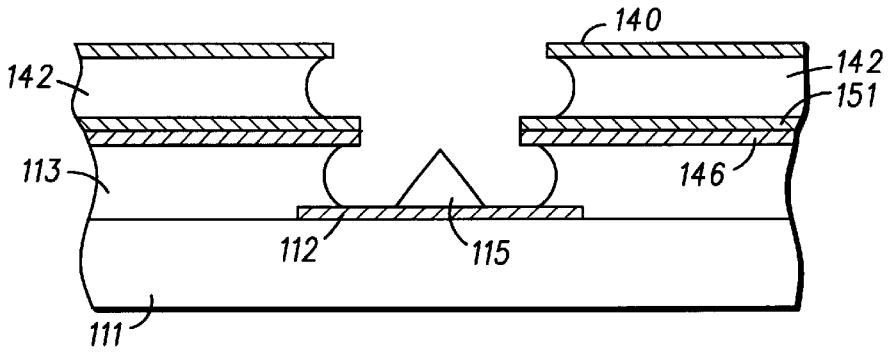

FIGS. 14–15 are cross-sectional views of structures realized during the fabrication of FED 100 of FIG. 13. First, cathode 112 is patterned onto substrate 111. Then, a dielectric layer is deposited onto cathode 112. A layer of the electron-emissive material of electron-emissive layer 146 is deposited on the dielectric layer. A layer of the conductive or non-conductive material of second layer 148 is deposited on the layer of the electron-emissive material. The two layers on the dielectric layer are etched to have the same pattern, so that a layer 151 is formed on electron-emissive layer 146. In particular, layer 151 overlies enhanced-emission structure 131. Layer 151 and electron-emissive layer 146 retain this overlapping configuration throughout the subsequent steps for forming electron emitter 115 (FIG. 14) and for forming second dielectric layer 142 and gate extraction electrode 140 (FIG. 15).

As illustrated in FIG. 14, layer 151 is useful for maintaining the mechanical integrity of enhanced-emission structure 131 while a lift-off layer 152 and a layer 154 of emitter material are deposited on layer 151 for forming electron emitter 115. After electron emitter 115 is formed in emitter well 114, lift-off layer 152 is removed, thereby also removing layer 154.

Thereafter, a layer of the dielectric material of second dielectric layer 142 is deposited on layer 151, and gate extraction electrode 140 is patterned onto this dielectric layer. Then, the dielectric material is partially etched to expose electron emitter 115. After second dielectric layer 142 is formed, layer 151 is partially etched back to expose enhanced-emission structure 131 and realize the configuration illustrated in FIG. 13.

Figure 16:
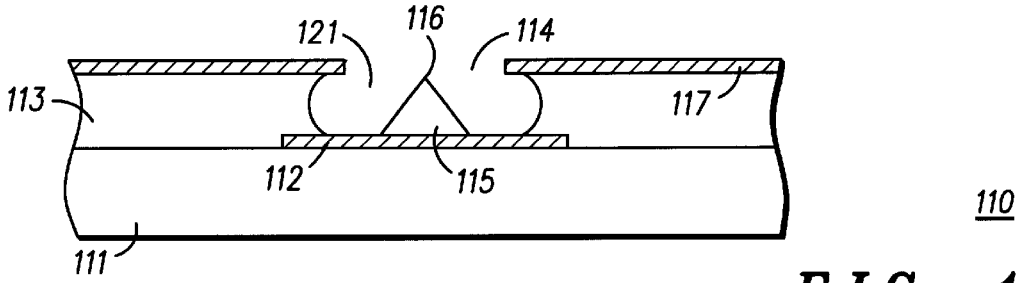
FIG. 16 is a cross-sectional view of a cathode plate having an emitter-enhancing electrode defining an opening, which has a non-circular shape, and further having an electron emitter, which has a circular cross-section in accordance with even another embodiment of the invention.

FIG. 16 is a cross-sectional view of cathode plate 110 having emitter-enhancing electrode 117 defining opening 121, which has a non-circular shape, and further having electron emitter 115, which has a circular cross-section, in accordance with even another embodiment of the invention.

Figure 17:
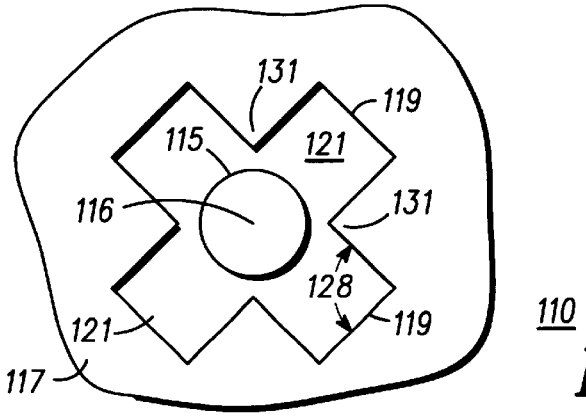
FIG. 17 is a top plan view of the cathode plate of FIG. 16.

FIG. 17 is a top plan view of cathode plate 110 of FIG. 16. In the embodiment of FIG. 17, the shape of the cross-section of electron emitter 115 is circular and is distinct from the shape of opening 121. Furthermore, distal edge 119 and enhanced-emission structure 131 together form an angle 128.

FIGS. 18–24 are cross-sectional and top plan views of structures realized during the fabrication of the embodiment of FIGS. 16–17. In general, the method described with reference to FIGS. 18–24 is useful for fabricating embodiments for which the shape of the opening defined by the emitter-enhancing electrode differs from the shape of the cross-section of the electron emitter. This method enables the formation of an electron emitter that does not have protruding edges, even though the distal edge of the emitter-enhancing electrode defines or partially defines, together with the enhanced-emission structure, an angle.

Figure 18:
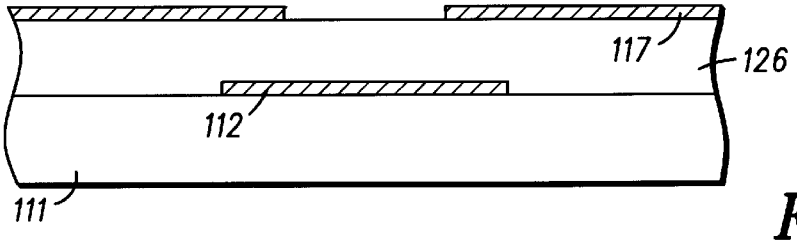
FIGS. 18–24 are cross-sectional and top plan views of structures realized during the fabrication of the embodiment of FIGS. 16–17.

FIG. 18 is a cross-sectional view of the structure formed subsequent to the patterning of emitter-enhancing electrode 117.

Figure 19:
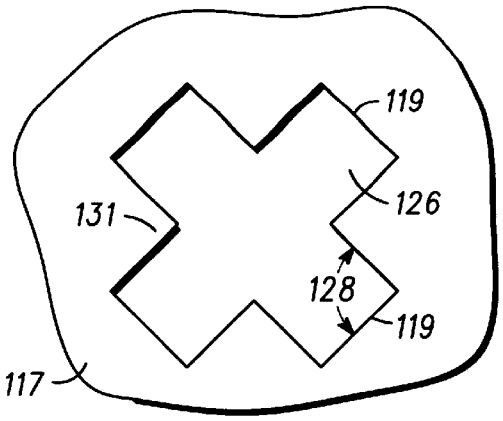
Figure 20:
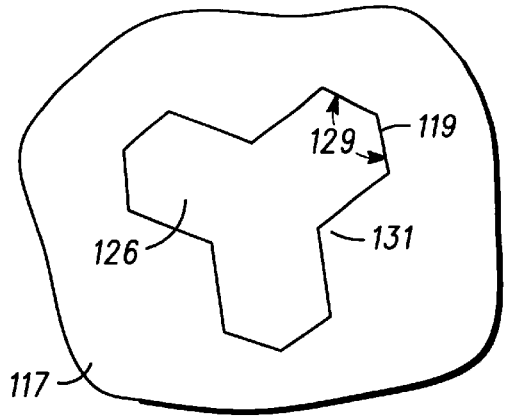

FIG. 19 is a top plan view of the structure of FIG. 18. FIG. 20 is a view similar to that of FIG. 19 of another embodiment in which distal edge 119 alone defines an angle 129.

Figure 21:
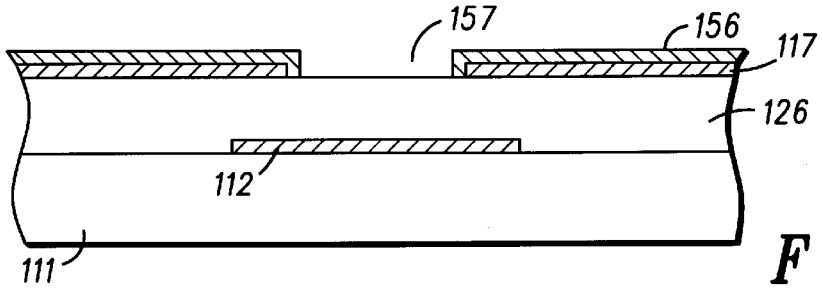

FIG. 21 is a cross-sectional view of the structure realized after a mask layer 156 is formed on emitter-enhancing electrode 117. Mask layer 156 defines an opening 157, which will define the cross-section of electron emitter 115.

Figure 22:
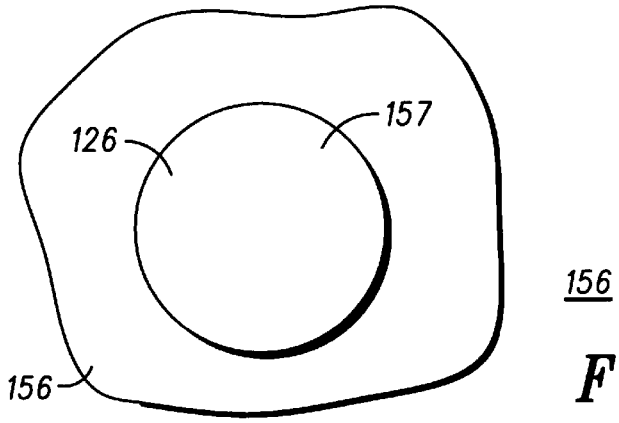

FIG. 22 is a top plan view of the structure of FIG. 21. As illustrated in FIG. 22, opening 157 of mask layer 156 is circular, which is useful for forming a conical electron emitter.

Figure 23:
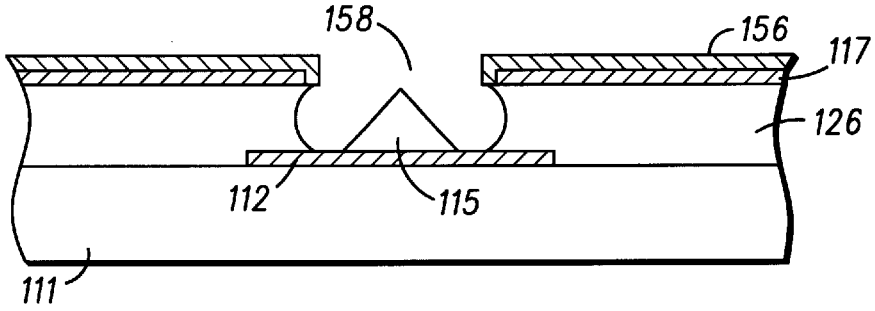

FIG. 23 is a cross-sectional view of the structure realized after performing the steps of etching layer 126 to form a deposition well 158 and, thereafter, forming electron emitter 115 within deposition well 158.

Figure 24:
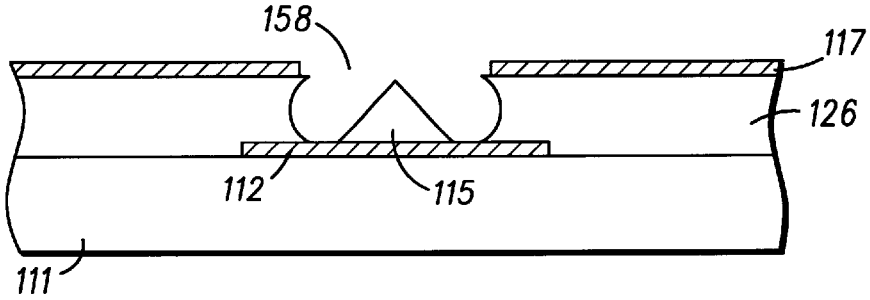

After the formation of electron emitter 115, mask layer 156 is removed, thereby forming the structure illustrated in FIG. 24. Thereafter, layer 126 is etched further, thereby realizing cathode plate 110 of FIG. 16.

In summary, the invention is for a field emission device having an emitter-enhancing electrode, which is useful for cleaning, conditioning, and sharpening the electron emitter. The field emission device of the invention provides the benefit of a stable electron current over the life of the device. It further provides the benefit of an improved device life.

While we have shown and described specific embodiments of the present invention, further modifications and improvements will occur to those skilled in the art. For example, the invention is also embodied by a device, similar to that of FIG. 13, in which the electron-emissive layer of the emitter-enhancing electrode is on top of the second layer, rather than beneath it. As a further example, the invention is embodied by a device in which the emitter-enhancing electrode includes only a thin, electron-emissive layer, which is less than about 500 angstroms thick and has no additional layers disposed on top of it. The emitter-enhancing electrode of this second example is thinner than any prior art gate extraction electrode, thereby providing enhanced electron emission from the emitter-enhancing electrode during the conditioning mode of operation of the device.

We desire it to be understood, therefore, that this invention is not limited to the particular forms shown, and we intend in the appended claims to cover all modifications that do not depart from the spirit and scope of this invention.

What is claimed is:

1. A field emission device comprising:

an electron emitter; and an emitter-enhancing electrode having an enhanced-emission structure disposed proximate to the electron emitter, wherein the enhanced-emission structure comprises a tapered portion of the emitter-enhancing electrode, the tapered portion defining an electron emissive edge, wherein the emitter-enhancing electrode having a thickness, wherein the tapered portion extends a distance within a range of two to three times the thickness of the emitter-enhancing electrode in a direction away from the electron-emissive edge and into the emitter-enhancing electrode.

2. A field emission device comprising:

an electron emitter having an axis; and an emitter-enhancing electrode having an enhanced-emission structure disposed proximate to the electron emitter, wherein the enhanced-emission structure defines an electron-emissive edge, and wherein the electron-emissive edge is generally parallel to the axis of the electron emitter.

3. The field emission device as claimed in claim 1, wherein the emitter-enhancing electrode defines an opening having a shape, and wherein a cross-section of the electron emitter has the shape of the opening.

4. The field emission device as claimed in claim 1, wherein the emitter-enhancing electrode defines an opening having a first shape, and wherein a cross-section of the electron emitter has a second shape, and wherein the first shape differs from the second shape.

5. The field emission device as claimed in claim 1, wherein the emitter-enhancing electrode comprises a conductive layer and an electron-emissive layer, wherein the conductive layer defines an edge disposed proximate to the electron emitter, and wherein the electron-emissive layer is disposed proximate to the edge of the conductive layer.

6. The field emission device as claimed in claim 5, wherein the electron-emissive layer at least partially coats the edge of the conductive layer.

7. The field emission device as claimed in claim 5, wherein the electron-emissive layer comprises carbon.

8. The field emission device as claimed in claim 1, wherein the emitter-enhancing electrode comprises an electron-emissive material.

9. The field emission device as claimed in claim 8, wherein the emitter-enhancing electrode comprises molybdenum.

10. A field emission device comprising:

an electron emitter defining an electron-emissive tip; and an emitter-enhancing electrode having an enhanced-emission structure disposed proximate to the electron emitter, wherein the emitter-enhancing electrode defines a distal edge coextensive with the enhanced-emission structure, and wherein a first distance between the distal edge and the electron-emissive tip is greater than a second distance between the enhanced-emission structure and the electron-emissive tip.

11. The field emission device as claimed in claim 10, wherein the electron emitter has an axis, wherein the enhanced-emission structure defines an electron-emissive edge, and wherein the electron-emissive edge is generally parallel to the axis of the electron emitter.

12. The field emission device as claimed in claim 10, wherein the distal edge defines a smooth curve and does not define an angle.

13. The field emission device as claimed in claim 10, wherein the distal edge at least partially defines an angle.

14. The field emission device as claimed in claim 1, wherein the electron emitter defines an electron-emissive tip, and wherein the position of the enhanced-emission structure of the emitter-enhancing electrode is selected so that electrons emitted by the enhanced-emission structure are received by the electron-emissive tip of the electron emitter.

15. A field emission device comprising:

an electron emitter; and an emitter-enhancing electrode having an enhanced-emission structure disposed proximate to the electron emitter, wherein the emitter-enhancing electrode comprises an electron-emissive layer having a thickness of less than 500 angstroms.

16. The field emission device as claimed in claim 15, wherein the emitter-enhancing electrode further comprises a second layer defining an edge, wherein the electron-emissive layer defines an edge, and wherein the edge of the second layer is spaced apart from the edge of the electron-emissive layer in a direction away from the electron emitter.

17. The field emission device as claimed in claim 16, further comprising a dielectric layer defining an emitter well, wherein the electron emitter is disposed within the emitter well, wherein the electron-emissive layer is disposed on the dielectric layer, and wherein the second layer is disposed on the electron-emissive layer.

18. The field emission device as claimed in claim 16, wherein the second layer comprises a conductive material.

19. A field emission device comprising:

an electron emitter;

an emitter-enhancing electrode having an enhanced-emission structure disposed proximate to the electron emitter, wherein the emitter-enhancing electrode defines an opening; and a gate extraction electrode defining an opening, wherein the opening defined by the emitter-enhancing electrode is in registration with the opening defined by the gate extraction electrode.

20. The field emission device as claimed in claim 19, further comprising a first dielectric layer and a second dielectric layer, wherein the first dielectric layer defines an emitter well, wherein the electron emitter is disposed within the emitter well, wherein the emitter-enhancing electrode is disposed on the first dielectric layer, wherein the second dielectric layer is disposed on the emitter-enhancing electrode, and wherein the gate extraction electrode is disposed on the second dielectric layer.

* * * * *